United States Patent [19]

Radford

[11] Patent Number: 4,607,710

[45] Date of Patent: Aug. 26, 1986

[54] CAMMED AND SHROUDED CORE CATCHER

[75] Inventor: Steven R. Radford, West Jordan, Utah

[73] Assignee: Norton Christensen, Inc., Salt Lake City, Utah

[21] Appl. No.: 646,578

[22] Filed: Aug. 31, 1984

[51] Int. Cl.[4] ..... E21B 25/00; E21B 49/02

[52] U.S. Cl. ..... 175/249; 175/58

[58] Field of Search ..... 175/20, 58, 276, 244–251, 175/253, 255, 257, 268, 309, 404; 166/318

[56] References Cited

U.S. PATENT DOCUMENTS

| | | | |
|---|---|---|---|
| 1,808,009 | 6/1931 | Scott | 175/251 |
| 1,994,847 | 3/1935 | Baker | 175/250 X |
| 2,140,417 | 12/1938 | Conklin | 175/248 |
| 2,870,838 | 1/1959 | Aston | 175/251 |
| 3,768,580 | 10/1973 | Mann et al. | 175/58 X |
| 3,878,904 | 4/1975 | Dobson | 175/58 X |

FOREIGN PATENT DOCUMENTS

| | | | |
|---|---|---|---|
| 620535 | 8/1978 | U.S.S.R. | 175/246 |
| 1033702 | 8/1983 | U.S.S.R. | 175/249 |

*Primary Examiner*—Stuart S. Levy
*Assistant Examiner*—Thomas R. Hannon
*Attorney, Agent, or Firm*—Beehler, Pavitt, Siegemund, Jagger, Martella & Dawes

[57] ABSTRACT

A positively driven full closure core catcher for use with soft or unconsolidated cores is comprised of an inner tube shoe into which a plurality of windows have been cut. In each window is a corresponding one of a plurality of flapper valves. The flapper valves are spring-biased to a withdrawn position outside of the interior of the inner tube shoe. A cam member is in sliding contact with an inclined rear surface of the flapper valve. Longitudinal displacement of the cam member with respect to the inclined surface of the flapper valve causes the cam to ride down the inclined surface of the valve thereby forcing the rotatable flapper valve into the interior of the inner tube shoe and into a fully closed position. The cam member is substantially radially fixed and is selectively disengaged from the inner tube shoe to which it is temporarily coupled by a collet assembly. The collet assembly is coupled to a cylinder on which the cam is fixed. Normally, the collet assembly will keep the cam and cylinder in a fixed longitudinal relationship with respect to the inner tube shoe. However, as the inner barrel is raised the collet latch of the collet assembly contacts a floating outer tube ring which causes the collet latch to bend outwardly and release from the inner tube shoe. The cylinder and cam are then longitudinally fixed within the coring tool and the inner tube and inner tube shoe continue to be longitudinally displaced. This causes the cam to ride down and close the flapper valves.

14 Claims, 3 Drawing Figures

20
54
22
52
50
18
62
66
68
24
64
66
60
74
74
70
28
42
40
40
26
36
44
36
58
38
36
26
34
38
48
30
56
72
46
52
16
12
10
14

CAMMED AND SHROUDED CORE CATCHER

BACKGROUND OF THE INVENTION

The present invention relates to the field of earth-boring tools, more particularly to core catchers contained within coring tools, which core catchers provide a full or complete closure of the core barrel.

DESCRIPTION OF THE PRIOR ART

In a rotating bit, a coring tool is typically comprised of a toroidally shaped coring bit defined by an outer gage and inner gage. The coring bit cuts a cylindrical core from the rock formation, which core is then disposed through its inner gage and generally aligned with the longitudinal axis of the drill string. The coring bit is typically coupled to a bit shank which is coupled to an outer coring barrel and drill collar, and in turn to a drill pipe, which extends to the ground surface and through which drill pipe the rotary motion is transmitted to the coring bit. Since hydraulic fluid is forced down through the inside of the drill pipe and ultimately the inner gage of the coring bit, a coring bit typically includes an inner barrel and one or more inner concentric sleeves aligned with the longitudinal axis of the drill string. Once the core is cut, particularly in a consolidated formation, some means is required to break or detach the core from the rock formation from which it extends. The prior art has devised a number of different designs for core catchers which are a collection of wedge shape, curved segments. Segments collectively form a cylindrical split ring having an internal diameter which frictionally engages the outside surfaces of the core as the barrel is moved downwardly over the core. After the core is cut, the core barrel pulled upwardly. The core catcher seizes upon the core and is moved downwardly with respect to the core barrel against an internal frustoconical surface on an inner diameter of the coring tool. Thus, the core catcher becomes wedged between the interior surface of the coring tool and the core. Ultimately, this allows the full tension applied to the drill string to be applied to the core. The core is hence broken from the rock formation and retained in the core barrel for removal and retrieval at the surface.

However, the use of such a traditional core catcher is entirely ineffectual in fragmented, loose, sandy or otherwise unconsolidated formations. Firstly, many of such cores need not be broken from their underlying rock formations. Secondly, such traditional rigid core catchers are unable to seize upon the core and wedge it within the core barrel with the result that some or all of the core is lost as the coring tool is tripped from the borehole. In order to overcome these difficulties, the prior art has devised a number of full closure catchers which are typically multiple cusped flapper valves installed in the interior of the core barrel in such a manner that the core is allowed to move upwardly within the core barrel, but upon any downward movement of the core, the flapper valves engage the core and are rotated to a shut or fully closed position. Thus, even for a sand core the relative downward movement of the sand column relative to the flapper valves causes the flapper valves to dig into the sand core and rotate to provide a full closure of the inner diameter of the core barrel.

However, even with such full closure core catchers the placement of the flapper valves within the core barrel tends to create an obstruction upon which the core may jam as it is being cut; or provides a means which physically disturbs the original stratification in the core. Furthermore, the activation of such prior art core catchers is based upon frictional contact with the adjacent core and the relative movement of the core with respect to the flapper valves. This movement in turn is typically gravitationally induced in the sense that as the core barrel is tripped from the hole, the unconsolidated core tends to fall out of the core barrel. However, retention of the unconsolidated core within the core barrel is not always reliable. Even in those prior art embodiments wherein the flapper valves are spring biased to close in against the core, the amount of force available through any spring mechanism to urge the flapper valve against and into the core into closed position is necessarily limited.

Therefore, what is needed to a full closure core catcher which overcomes each of the defects of the prior art designs, and in particular, a full closure core catcher which presents no obstacles or opportunity to jam or disturb the core as it is being cut and disposed within the core barrel, but which is reliably and securely driven into a closed position once cutting of the core is finished.

BRIEF SUMMARY OF THE INVENTION

The present invention is a full closure core catcher for use within a coring tool. The coring tool includes an inner tube or barrel and is characterized by a longitudinal axis. The invention comprises a first mechanism for providing full closure of the inner barrel. A second mechanism adjacent to the first mechanism actuates the first mechanism to move from an open position to a closed position. A third mechanism selectively actuates the second mechanism as the inner barrel is relatively longitudinally displaced within the coring tool. By reason of this combination of elements, a full closure core catcher is provided which is positively actuated when the inner barrel is relatively displaced within the coring tool without any dependency upon downward movement or tension of the core within the coring tool.

More specifically, the present invention comprises a core catcher for use in a coring tool, including an inner barrel which is disposed within a coring tool. An inner tube shoe is coupled to the inner barrel. A plurality of flapper valves are rotatably coupled to the inner tube shoe and are rotatable into the interior of the inner tube shoe through a window defined in the inner tube shoe. The flapper valves are biased by tortional springs into a retracted position which is entirely withdrawn from the interior of the inner tube shoe. A cam mechanism is provided for selectively rotating each of the plurality flapper valves into the interior of the inner tube shoe. A collet assembly actuates the cam mechanism and is coupled thereto. By reason of this combination of elements, the plurality of flapper valves are biased out of the inner tube shoe in the normal open configuration and are selectively and positively displaced into the inner tube shoe independently of the core in the closed configuration. The invention and its various embodiments are better understood by now considering the following drawings.

Turn now to the detailed description wherein the invention and its various embodiments may be better understood.

DETAILED DESCRIPTION OF THE PREFERRED EMBODIMENTS

The present invention is a cammed, full closure core catcher which is positively driven by a cam block from an opened to a closed position. Moreover, the core catcher is concealed within the wall of an inner tube so that no protusion, extension or other projection of the core catcher or its mechanism extends into the internal cylindrical area of the core barrel to provide any means for jamming or disturbing the core.

Figure 1:
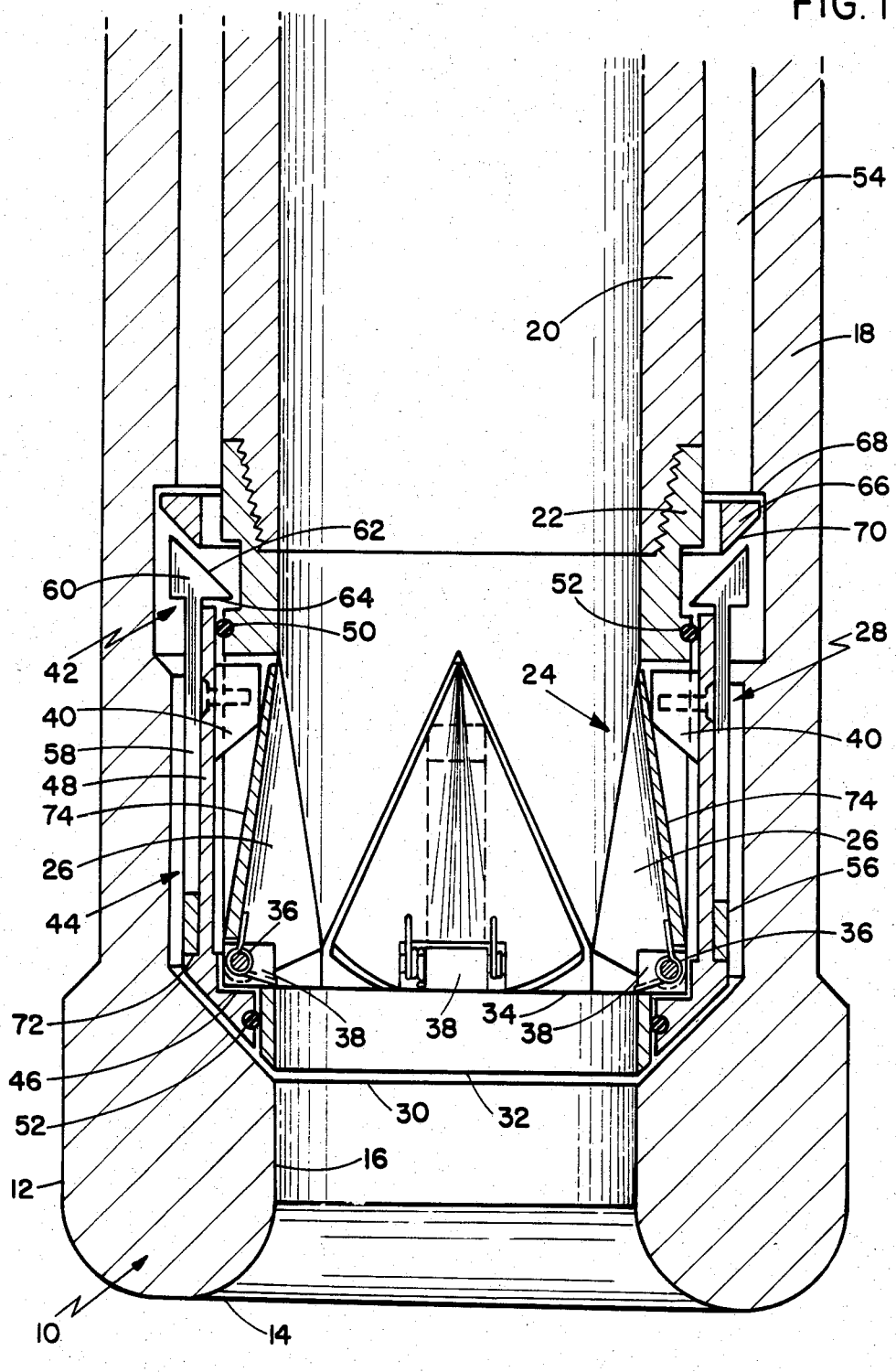
FIG. 1 is a cross-sectional view of one embodiment of the invention shown in the opened position.

Turn now to FIG. 1 which is a diagrammatic sectional view of one embodiment of the invention wherein one of the flapper valves and its associated cam mechanism are depicted. A conventional coring bit, generally denoted by reference numeral 10, which is further characterized by an outer gage 12, crown 14 and inner gage 16 is shown in cross-sectional view. Bit 10 is conventionally coupled to a bit shank 18 and has disposed therein an inner barrel 20 designed to receive the core (not shown). Inner barrel 20 is coupled at its lower end to an inner tube shoe 22. Inner tube shoe 22 carries the core catcher of the invention. More particularly, the core catcher generally denoted by reference numeral 24, is comprised of a plurality of flapper valves 26, one of which is illustrated in FIG. 1. The plurality of valves 26 are better illustrated in the perspective view in FIG. 3. Core catcher 24 further includes a latch assembly 28 circumferentially disposed outside of inner tube shoe 22. Flapper valve 26 is disposed between latch assembly 28 and inner tube shoe 22. Inner tube shoe 22 extends downwardly to a lower edge 30 above inner gage 16 of bit 10. A gap 32 between lower edge 30 and the upper edge of inner gage 16 is provided for the flow of hydraulic fluid according to conventional principles. In any case, inner tube shoe 22 is positioned within the core barrel and with respect to bit 10 to provide as smooth a transition from inner gage 16 to inner barrel 20 as possible.

Figure 2:
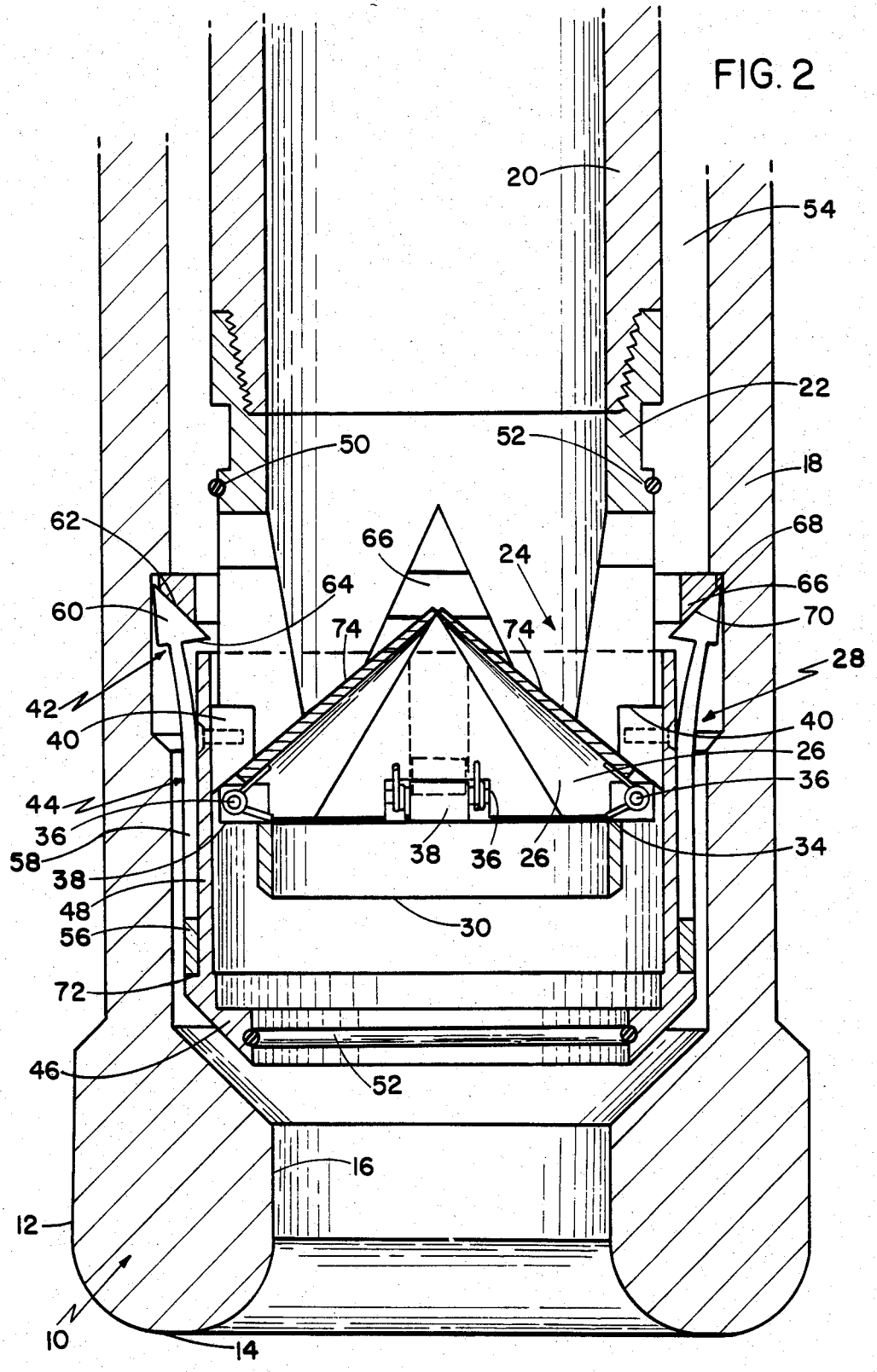
FIG. 2 is the cross-sectional view of FIG. 1 wherein the core catcher has been closed.
Figure 3:
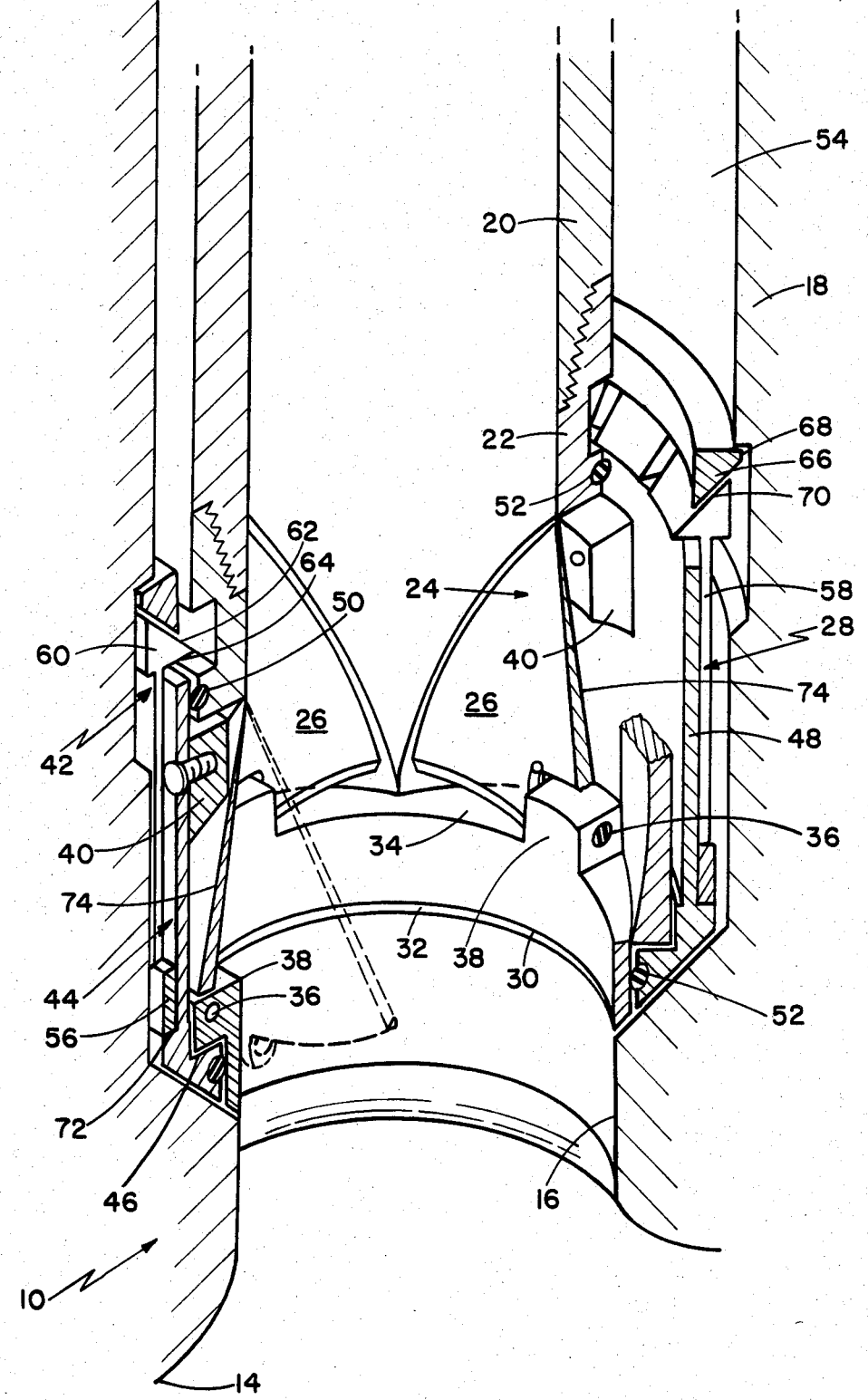
FIG. 3 is a partially cut-away perspective view of the embodiments of FIGS. 1 and 2.

Inner tube shoe 22 includes a window 34 cut therein, best illustrated in FIG. 3. Window 34 is sized to freely allow flapper valve 26 to rotate therethrough, again as best depicted in the cross-sectional view of FIG. 2. As shown in FIG. 1, flapper valve 26 is generally spring biased by coil spring to a closed position withdrawn within or behind window 34. Flapper valve 26 is pivotally coupled to shoe 22 by pivot 36 defined through a radial flange 38. A spring (not shown) is disposed about pivot 36 in a conventional manner and is used to maintain flapper 26 in the open or upright position of FIG. 1 until acted upon by cam 40 and forced into the closed position such as shown in FIGS. 2 and 3.

Consider now latch assembly 28. Latch assembly 28 is comprised of a collet latch, generally denoted by reference numeral 42, and a cam assembly 44. Cam assembly 44 is a cylindrical member disposed about the lower end of shoe 22 and is retained thereat by an appropriate means. In the illustrated embodiment this means comprises a flange portion 46 which has a radial overlapping relationship with bracket 38 of inner shoe 22. As best seen in the cross-sectional views of FIGS. 1 and 2, upward longitudinal movement of cam assembly 44 with respect to shoe 22 is substantially limited or prevented by the juxtaposition of lower portion 46 of cam assembly 44 and flange 38 of shoe 22. Cam assembly 44 extends upwardly from portion 46 in the form of the longitudinal extending tube 48 to which cam block 40 is attached or fixed. The upper portion of arm 48 extends a short longitudinal distance beyond cam block 40 to form a fluidic seal with O-ring 50 disposed within an upper circumferential flange 52 of shoe 22. Hydraulic fluid thus flowing downwardly within annulus 54 between inner tube 20 and the interior of the drill pipe or bit is prevented from leaking into the interior of inner tube 20 or shoe 22 by virtue of the O-ring seal between ring 50 and cam assembly 44.

Circumferentially disposed outside of cam assembly 44 is collet 42. Collet 42 is characterized by a lower, circumferentially continuous cylindrical band 56 from which a resilient arm or tine 58 extends longitudinally upwardly terminating in a collet block 60. Collet block 60 is characterized by an inclined surface 62 and an inwardly radially extending lower edge 64 disposed in an overlapping relationship with the upper radial surface of flange 52 of shoe 22. Therefore, as shown in FIG. 1, normally latch assembly 28 is longitudinally secure both from upward and downward displacements by surface 64 of collet block 60 in or near contact with upper flange 52 on one hand, and by lower portion 46 of cam assembly 44 in overlapping relationship with the lower surface of lower flange 38 on the other hand.

Circumferentially disposed within annular space 54 is a free floating outer tube ring 66. Outer tube ring 66 has a large enough diameter so that it lies in a radially overlapping relationship with a shoulder 68 defined on the inside of the shank of bit 10 or other equivalent means defined within the bit shoe, drill collar or other pertinent structure within the drill string. Tube ring 66 is characterized by a mating, inclined surface 70 which matches inclined surface 62 of collet block 60. Therefore, as inner barrel 20 and shoe 22 are moved upwardly within the drill string as depicted in FIG. 2, collet block 60 similarly moves upwardly until surface 62 of collet block 60 and surface 70 of tube ring 66 contact. After the point of contact is established, the inclined surfaces will cause collet block 60 to be displaced radially outward to an extent which ultimately destroys the overlapping relationship between surface 64 of collet block 60 and the upper surface of flange 52. At this point, collet latch 42 is substantially longitudinally fixed within the drill string or bit. As inner barrel 20 and shoe 22 continue to move upwardly, cam assembly 44 will similarly remain longitudinally fixed by virtue of its interfitting relationship with collet latch 42, as established by the juxtaposition of cylindrical band 56 within a mating shoulder 72 defined within the lower portion of cam assembly 44.

Therefore, cam block 40, which remains stationary, is drawn downwardly across the back surface 74 of flapper valve 26. As shown in FIG. 2, the upward movement of flapper valve 26 with respect to cam block 40 or equivalently, the downward movement of collet block 40 across back 74 of flapper valve 26 will cause valve 26 to rotate inwardly through window 34 and ultimately to assume the fully closed position as indicated in FIGS. 2 and 3. The relative upward longitudinal movement of inner shoe 22 is effectuated by any means well known to the art, such as an internal hydraulic actuator shown and described in co-pending application entitled A Hydraulic Lift Inner Barrel In A Drill String, Ser. No.

530,492 now U.S. Pat. No. 4,553,613 assigned to the same assignee of the present invention.

During operation, the unconsolidated core may also tend to fall downwardly within inner barrel 20 and thereby further assist in rotating flapper valves 26 inwardly to the closed position and maintaining them in a closed position. However, the downward movement of the core is not required according to the invention which positively actuates flapper valve 26. The maintenance of the closed configuration of flapper valves 26 in FIG. 3 can be insured by the weight of the core, or alternatively, by means of a ratchet assembly (not shown) well known in the art which allows relative movement of inner barrel 20 with respect to the drill string only in the upward direction.

It must be understood that many modifications and alterations may be made by those having ordinary skill in the art without departing from the spirit and scope of the invention. The illustrated embodiment has been set forth only by way of example and should not be taken as limiting the invention which is defined in the following claims.

I claim:

1. A full closure core catcher disposed within a coring tool, said tool having an inner barrel for cutting a core comprising:

a plurality of closeable valves smoothly forming a portion of said inner barrel and displaceable within said inner barrel to fully close said inner barrel wherein each of said plurality of valves is rotatively coupled to said inner barrel and disposable through a window defined in said inner barrel, and further comprising means for biasing each valve in a withdrawn and open configuration; and means for positively displacing each of said plurality of valves into said inner barrel in opposition to said means for biasing each valve in a withdrawn and open configuration, whereby full closure of said inner barrel is provided without dependency upon descent of said core within said inner barrel.

2. A core catcher for use in a coring tool, including an inner barrel disposed within said coring tool comprising:

an inner tube shoe coupled to said inner barrel;

a plurality of flapper valves rotatably coupled to said inner tube shoe, each valve rotatable into the interior of said inner tube shoe through a corresponding window defined in said inner tube shoe, said flapper valves smoothly forming a portion of said inner tube shoe and forming a substantial closure across said corresponding window;

first means for biasing each of said plurality of flapper valves in a retracted position entirely withdrawn from said interior from said inner tube shoe;

second means for selectively rotating each of said plurality of flapper valves into said interior of said inner tube shoe in opposition to said first means for biasing each of said plurality of flapper valves; and third means for actuating said second means, said third means being coupled to said second means, whereby said plurality of flapper valves are biased out of said inner tube shoe and are positively displaced therein independently of a core within said inner barrel.

3. The core catcher of claim 2 wherein each said flapper valve is rotationally coupled to said inner tube shoe at a point on said inner tube shoe outside said interior of said inner tube shoe and whereby said first means for biasing each of said plurality of flapper valves comprises a torsional spring coupled to each of said flapper valves for urging each said flapper valve to rotate about its point of rotational coupling to said inner tube shoe into a position generally longitudinally aligned with said inner tube shoe.

4. The core catcher of claim 2 wherein said second means for selectively rotating each of said flapper valves comprises a substantially rigid cylinder concentrically disposed about and outside said inner tube shoe, each of said flapper valves being disposed between said cylinder and inner tube shoe, said cylinder provided with at least one cam member corresponding to each of said flapper valves, said cam member arranged and configured to slidingly contact said flapper valve along a longitudinally inclined surface of said flapper valve, whereby longitudinal displacement of said cam member with respect to said inclined surface of said flapper valve causes said flapper valve to rotate into said interior of said inner tube shoe.

5. The core catcher of claim 4 wherein said cam member comprises an integral, rigid cylindrical ring affixed to said cylinder and disposed between said cylinder and said inner tube shoe.

6. A full closure core catcher for use within a coring tool having an inner tube and longitudinal axis comprising:

first means for providing full closure of said inner tube, said first means capable of assuming an open and a closed position;

second means adjacent to said first means for actuating said first means to move from said open position to said closed position; and third means for selectively actuating said second means as said inner tube is relatively longitudinally displaced within said coring tool, wherein said first means comprises a plurality of flapper valves and said second means comprises a plurality of longitudinally driven cams, each said cam being adjacent one of said flapper valves, said surface of contact of said flapper valve lying along an outwardly inclined surface with respect to said longitudinal axis, said cam being longitudinally displaced in said coring tool, thereby causing said flapper valves to be inwardly radially displaced by said relative movement of said cam;

wherein said third means comprises a collet latch and tube ring, said collet latch selectively fixed with respect to said inner tube and coupled to said cam, said tube ring disposed within said coring tool, longitudinal displacement of said tube ring within said coring tool being limited at least in one direction, said tube ring arranged and configured to selectively contact said collet latch to actuate said collet latch thereby releasing said collet latch from said inner tube and allowing said cam and collet latch to be longitudinally displaced with respect to each other, whereby a full closure core catcher is provided which is positively actuated when said inner tube is relatively displaced within said coring tool.

7. A full closure core catcher disposed within a coring tool, said tool having an inner barrel for cutting a core comprising:

a plurality of closeable valves disposed outside said inner barrel and displaceable within said inner barrel to fully close said inner barrel; and means for positively displacing each of said plurality of valves into said inner barrel, wherein each of said plurality of valves is rotatively coupled to said inner barrel and disposable through a window defined in said inner barrel, and further comprising means for biasing each valve in a withdrawn and open configuration, wherein said means for positively displacing each said valve comprises a longitudinally displaceable cam assembly, said cam assembly including at least one cam member corresponding to each said valve, each cam member contacting a longitudinally inclined surface of said corresponding valve such that longitudinal relative displacement of said cam member along said surface of said valve causes said valve to be displaced in said inner barrel, wherein said means for positively displacing each of said valves further comprises a collet assembly, said collet assembly coupled to said cam assembly, said collet assembly comprising a collet latch and a floating outer tube ring, said collet latch temporarily securing said cam assembly to said inner barrel so that said cam member and said corresponding valve are relatively fixed with respect to each other, said tube ring for selectively disengaging said collet latch from said inner barrel and for fixing the relative disposition of said collet assembly and cam assembly with respect to said coring tool while said inner barrel is longitudinally displaced with respect to said coring tool, whereby said cam member is longitudinally relatively and selectively displaced with respect to said corresponding valve thereby causing said valve to rotate inwardly from an open position to a fully closed position, and whereby full closure of said inner barrel is provided without dependency upon descent of said core within said inner barrel.

8. A core catcher for use in a coring tool, including an inner barrel disposed within said coring tool comprising:

an inner tube shoe coupled to said inner barrel;

a plurality of flapper valves rotatably coupled to said inner tube shoe and rotatable into the interior of said inner tube shoe through a window defined in said inner tube shoe;

first means for biasing each of said plurality of flapper valves in a retracted position entirely withdrawn from said interior from said inner tube shoe;

second means for selectively rotating each of said plurality of flapper valves into said interior of said inner tube shoe; and third means for actuating said second means, said third means being coupled to said second means, whereby said plurality of flapper valves are biased out of said inner tube shoe and are positively displaced therein independently of a core within said inner barrel;

wherein said second means for selectively rotating each of said flapper valves comprises a substantially rigid cylinder concentrically disposed about and outside said inner tube shoe, each of said flapper valves being disposed between said cylinder and inner tube shoe, said cylinder provided with at least one cam member corresponding to each of said flapper valves, said cam member arranged and configured to slidingly contact said flapper valve along a longitudinally inclined surface of said flapper valve, wherein said third means for actuating said second means comprises a collet assembly coupled to said cylinder, said collet assembly including means for selectively decoupling said cylinder from said inner tube shoe and for selectively longitudinally fixing said cylinder with respect to said coring tool while permitting said inner tube shoe to be longitudinally displaced with respect to said cylinder and cam member, whereby longitudinal displacement of said cam member with respect to said inclined surface of said flapper valve causes said flapper valve to rotate into said interior of said inner tube shoe.

9. The core catcher of claim 8 wherein said means for decoupling and fixing comprises as least one resilient arm longitudinally extending parallel to said cylinder and forming a collet latch, said collet latch being arranged and configured to selectively engage said inner tube shoe to prevent longitudinal displacement of said collet assembly with respect to said inner tube shoe when in a first position and to selectively assume a second position arranged and configured to prevent longitudinal movement of said collet assembly with respect to said coring tool while permitting longitudinal displacement of said inner barrel and inner tube shoe with respect to said collet assembly.

10. The core catcher of claim 9 wherein said collet assembly further comprises a floating outer tube ring longitudinally fixed with respect to said coring tool in at least one direction, said ring having an inclined surface and said collet latch having a corresponding and mating inclined surface, said collet latch and ring being disposed within said coring tool to assume a mutually interfering position as said inner barrel is longitudinally displaced within said coring tool, said interfering position being characterized by contact between said two corresponding inclined surfaces on said ring and collet latch, contact between said two inclined surfaces forcing said collect latch formed as part of said resilient arm in a radially outward direction thereby releasing said collet assembly from selective interlocking engagement with said inner tube shoe and thereby fixing said collet assembly longitudinally within said coring tool.

11. The core catcher of claim 10 wherein said cylinder assumes a first position with respect to said inner tube shoe characterized by full withdrawal of each of said plurality of flapper valves from said interior of said inner tube shoe, said cylinder including an hydraulic seal between said cylinder and said inner tube to prevent hydraulic fluid from flowing through said window in said inner tube shoe into said interior.

12. The core catcher of claim 11 wherein said outer tube ring is a substantially rigid and integral ring and wherein a plurality of said resilient arms and corresponding collet latches are provided for contact with said outer tube ring.

13. The core catcher of claim 12 wherein said inner tube shoe includes a circumferential first annular groove defined therein, said collet latch being disposed within said first groove in a locking relationship whereby longitudinal displacement of said collet assembly with respect to said inner tube shoe is prevented in at least one direction, said outer tube ring displacing said collet latch of said collet assembly radially outward when said corresponding inclined surfaces of said outer tube ring and collet latch are in contact thereby withdrawing said collet latch from said first annular groove.

14. The core catcher of claim 13 wherein said inner tube shoe further defines a second annular groove at its lowermost end longitudinally displaced from said first annular groove, said cylinder being disposed in part within said second annular groove, said cylinder and cam member affixed thereto being temporarily longitudinally fixed with respect to said inner tube shoe by said interlocking relationship of said collet latch with said first inner groove and by disposition of said cylinder in said second annular groove.

* * * * *